US005500963A

United States Patent [19]

Yeh

[11] Patent Number: 5,500,963

[45] Date of Patent: Mar. 26, 1996

[54] SECURING DEVICE FOR INTERLOCKING TUBULAR BED FRAME BUNK BEDS

[76] Inventor: John Yeh, 660 S. Aberdeen, Anaheim Hills, Calif. 92807

[21] Appl. No.: 240,171

[22] Filed: May 9, 1994

[51] Int. Cl.[6] ..... A47C 19/02

[52] U.S. Cl. ..... 5/9.1; 5/294; 5/299; 403/407.1; 403/231

[58] Field of Search ..... 5/9.1, 288–291, 5/294, 295, 300, 304; 403/407.1, 405.1, 231

[56] References Cited

U.S. PATENT DOCUMENTS

| | | | |
|---|---|---|---|
| 793,903 | 7/1905 | Olson | 5/300 |
| 1,429,422 | 9/1922 | Gale | 5/304 |
| 5,171,099 | 12/1992 | Westre | 403/407.1 |

FOREIGN PATENT DOCUMENTS

| | | | |
|---|---|---|---|
| 1071513 | 9/1954 | France | 5/290 |
| 665961 | 2/1952 | United Kingdom | 5/300 |
| 898606 | 6/1962 | United Kingdom | 5/299 |

*Primary Examiner*—Alexander Grosz
*Attorney, Agent, or Firm*—Francis X. LoJacono

[57] ABSTRACT

The present invention comprises a novel device for fixedly attaching and securing at least one horizontal supporting tubular frame structure between a pair of vertically positioned end frame members of a bunk bed, whereby the attaching and securing device includes a pair of elongated tubular support frame members, each having depending wedge-shaped tongue members fixedly secured adjacent each end of the frame members so as to be receive in corresponding brackets fixedly attached to the oppositely disposed side posts of the end frame members. An elongated screw is positioned through each post and into each tubular support frame member in which is mounted a nut member adapted to receive the threaded end of the screw, whereby the tongue members are secured in place within sleeves formed in the respective brackets.

6 Claims, 2 Drawing Sheets

SECURING DEVICE FOR INTERLOCKING TUBULAR BED FRAME BUNK BEDS

BACKGROUND OF THE INVENTION

1. Field of the Invention

The present invention relates generally to an apparatus for attaching and securing horizontal frame members to vertical post members, and more particularly to an interlocking device that provides a positive means for attaching horizontal bed frame members between a pair of tubular end frame members that define a bunk bed frame structure.

2. Description of the Prior Art

As is well known in the art, there are various problems and difficulties that have been encountered in providing suitable means for securing horizontal tubular frame members to tubular end frame members, sometimes referred to as headboards and/or footboards, and in particular the securing of tubular bunk bed frame members to the tubular end frame members so as to establish positive and firm attachment of upper and lower bunk sections.

Many varieties of attaching devices are used for mounting horizontal bed frame members between a pair of vertical end frame members so as to support the box springs and/or mattresses. There seems to be as many types of attaching means as there are beds. However, these devices have various design weaknesses that create limitations which restrict their use, particularly with respect to bunk beds having tubular frame structures. Moreover, some types of attaching devices for frame structures are complicated to assemble and do not provide positive means for securing elongated, horizontal, mattress support bars to bed posts that form part of the two vertical end frame structures of the bed, which will be hereinafter referred to as end frame members. This is particularly true when the end frame members are formed from metal frame members having oppositely positioned vertical tubular posts.

The most common attaching or securing device generally comprises an elongated angle bar that is provided at each end with an extended ear member having a pair of hook members that are positioned one above the other and are adapted to receive a matching pair of pins, each having a flat head member mounted to an extended angle bracket secured to the oppositely arranged bed post. The hook ends are slipped over the corresponding pins. This arrangement does not provide a positive connection, especially with respect to bunk beds that are formed from various tubular members. They have been known to separate, particularly if children are playing on the lower and upper bed sections. A child lying in the lower bunk can easily push the frame of the upper bunk with his or her feet, thus causing the frame members and mattresses to disconnect and fall onto the lower bunk.

OBJECTS AND ADVANTAGES OF THE INVENTION

The present invention comprises a novel device for fixedly attaching and securing a tubular frame support structure for a bed, and more particularly for a bunk bed wherein a mattress and a box spring can be safely supported on the upper and lower bunk sections. The end frame members of a bed are interconnected and fixedly secured to the respective ends of the horizontal tubular frame members by a combination attaching and securing device. The horizontal frame members are defined by a pair of elongated tubular support bars, each having oppositely disposed depending tongue members that are fixedly secured at each end of the bars so as to be received in corresponding narrow sleeve members that are fixedly attached to the oppositely disposed post of the end frame members. An elongated screw is positioned through the post and into the tubular support bar in which is mounted a nut member adapted to receive the threaded end of the screw, whereby the tongue members are secured in place within the sleeve of the post.

It is an important object of the present invention to provide an attaching and securing apparatus for fixedly attaching and positively securing the horizontal bed frame members to oppositely positioned end frame members.

Another object of the invention is to provide an attaching and securing device wherein the bed frame members are adapted to be secured to the oppositely positioned end frame members of a bed in a positive arrangement, and wherein the elongated horizontally disposed support frame members of the bed frame structure are arranged to carry and support the mattress and/or box spring by means of depending tongue members fixedly attached adjacent the opposite ends of each support frame, so as to be received in respective sleeve members mounted to the oppositely disposed post of the end frame members. The securing means comprises an elongated screw that is positioned horizontally through each respective post of the end frame members so as to extend inwardly of the support frame members, whereby the screws are secured to an internal nut mounted transversely of the elongated horizontal support bars.

Still another object of the present invention is to provide an attaching and securing device of this character that is easily assembled with few moving parts.

A further object of the present invention is to provide a device of this character that is relatively inexpensive to manufacture, and is simple yet rugged in construction.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

BRIEF DESCRIPTION OF THE DRAWINGS

With the above and related objects in view, the invention consists in the details of construction and combination of parts, as will be more fully understood from the following description, when read in conjunction with the accompanying drawings and numbered parts.

DESCRIPTION OF THE PREFERRED EMBODIMENT

Figure 1:
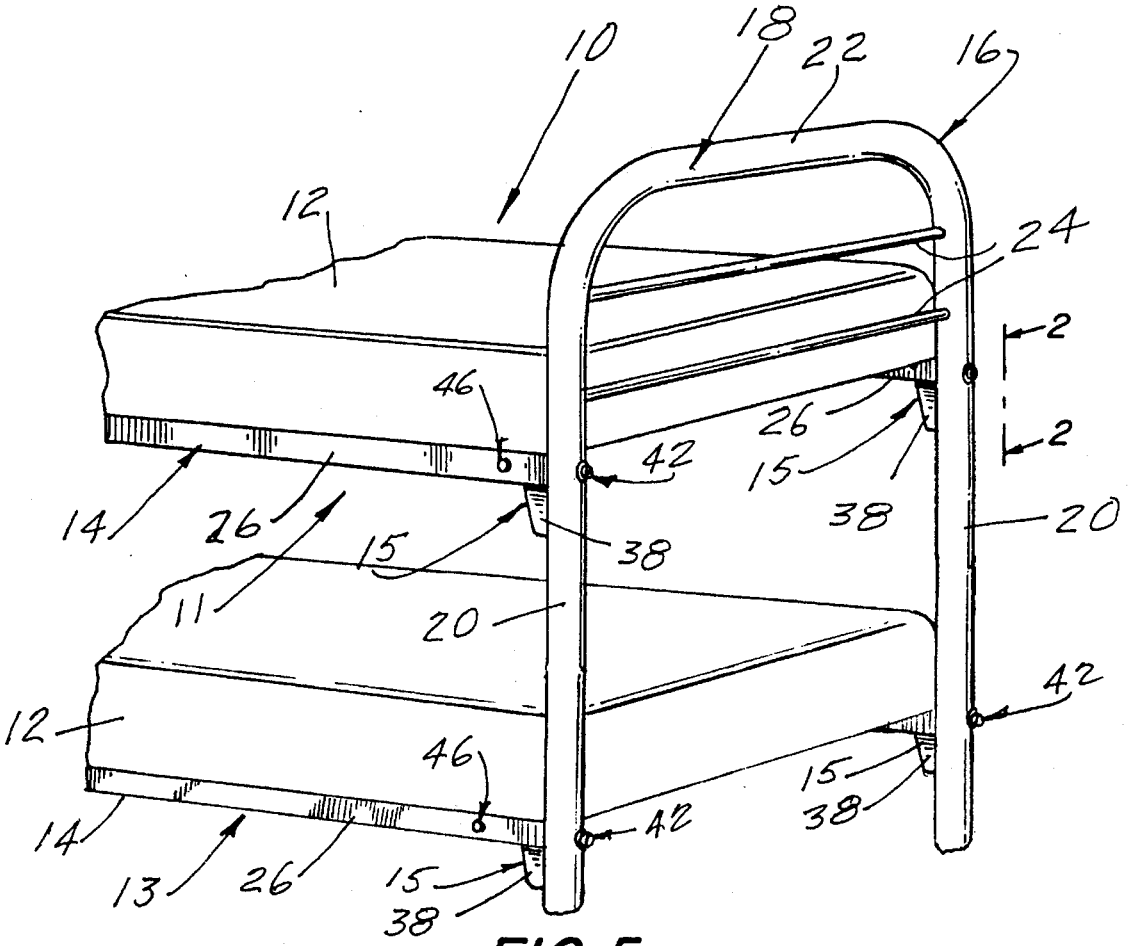
FIG. 1 is a partial perspective view of a top portion of a bunk bed showing the attaching and securing device of the present invention.

Referring more particularly to FIG. 1, there is shown a portion of a bunk bed, generally indicated at 10, having an upper section 11 and a lower section 13.

Accordingly, in FIG. 1, bunk bed 10 is illustrated as having each upper and lower sections 11 and 13 provided with a typical mattress 12 supported on respective upper and lower frame sections, designated generally by numeral 14, which are fixedly attached and secured to a vertically disposed end frame member 16 of the bunk bed by means of a combination attaching and securing means, which is generally indicated by numeral 15. End frame member 16 can be of any suitable configuration and is shown herein as a simple structure comprising a tubular frame member 18 defined by a pair of vertical posts 20 each having a horizontal top portion 22, wherein a pair of protective bars 24 are mounted between the two oppositely disposed vertical posts 20. Posts 20 are shown as having a circular or round cross-sectional configuration; however, any suitable tubular configuration may be provided, such as a square cross-sectional tube.

Figure 3:
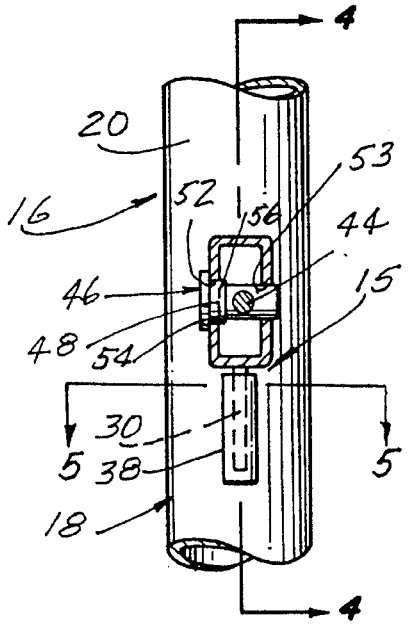
FIG. 3 is a cross-sectional view substantially taken along line 3—3 of FIG. 2 showing the position of the nut member inserted into the tubular support frame member.

The mattress supporting frame section 14 comprises a pair of horizontally disposed tubular frame members 26, which are shown as elongated tubular bars having rectangular cross-sectional configurations, as illustrated in FIG. 3. However, any suitable tubular configuration may be provided to carry out the present invention.

Figure 5:
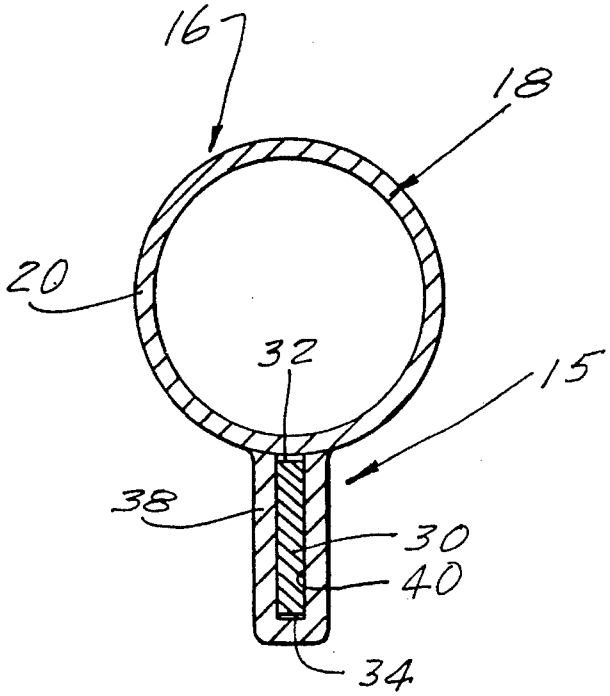
FIG. 5 is an enlarged cross-sectional view taken substantially along line 5—5 of FIG. 3.
Figure 2:
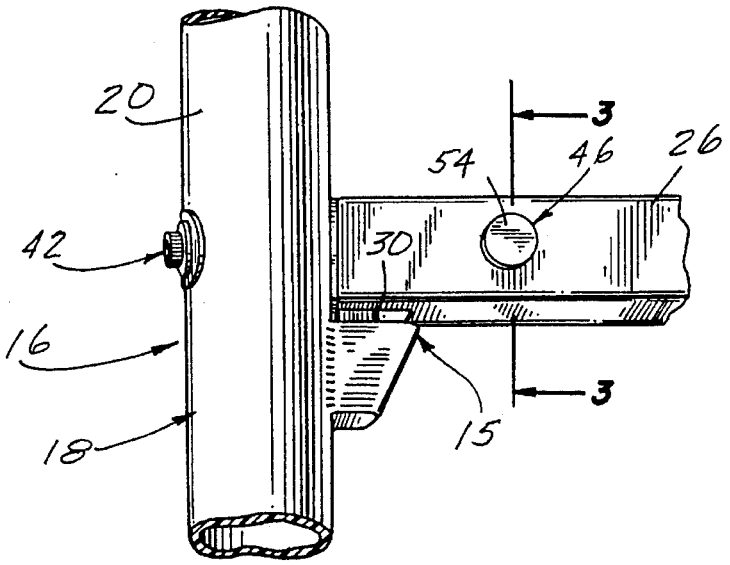
FIG. 2 is pictorial view taken in the direction of line 2—2 as indicated in FIG. 1.
Figure 4:
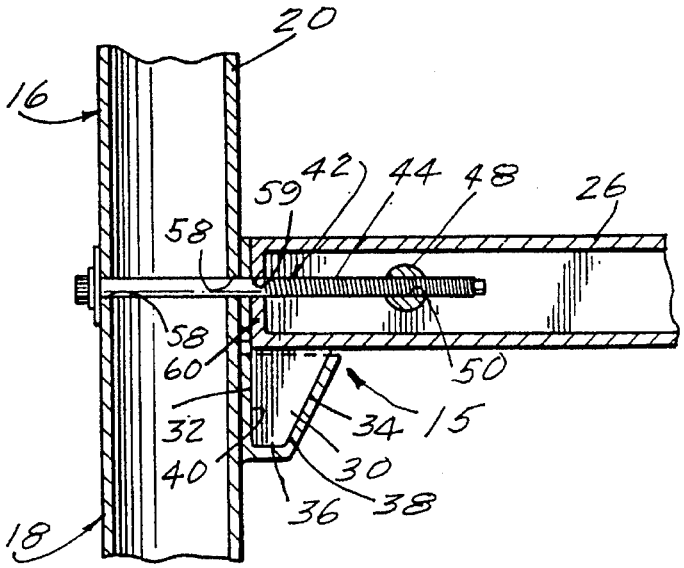
FIG. 4 is a cross-sectional view substantially taken along line 4—4 of FIG. 3 showing the placement of the attaching tongue and the horizontal position of the securing screw passing through the vertical post and the horizontal support bar member.

Accordingly, the present invention defines an attaching and securing means 15 which comprises a depending wedge-shaped tongue member 30 that is fixedly attached by suitable means, such as welding or the like, to the underside of each tubular frame member 26 adjacent the terminating ends thereof. Tongue member 30 is formed with a front vertical edge 32 and an opposite rear edge 34 that is inclined downwardly and inwardly providing a somewhat triangular configuration having a truncated lower end 36. Tongue 30 is adapted to be received in a mounting bracket 38 that is fixedly attached to each post of end frame member 16. Mounting bracket 38 is formed in a corresponding triangular configuration as that of tongue 30, wherein bracket 30 has a narrow sleeve in which slot 40 is provided to receive tongue 30 for attaching each respective frame member 26 to its respective post 20, as seen in FIGS. 3, 4 and 5. Tongue 30 fits tightly within slot 40 and is secured therein by a securing means, designated at 42, as illustrated in FIGS. 2, 3 and 4.

Securing means 42 comprises an elongated screw 44 and nut means 46 which is defined by an insert pin 48 having a transversely disposed threaded bore 50. In FIGS. 3 and 4 insert pin 48 is shown mounted in the side of frame 26 by means of a mounting holes 52 and 53, wherein insert pin 48 is formed having a head 54 and support collar 56. Screw 44 is horizontally inserted through a pair of aligned holes 58 located in post 20 so as to be centrally aligned with a receiving hole 59 formed in the closed end 60 of support bar 26. The screw is threaded into the threaded bore of insert pin 48, as illustrated in FIG. 4. Thus, it can be seen that screw 42 is securely mounted to holding bar 26 and post 20 to prevent any movement therebetween, thereby preventing tongue 30 from being inadvertently disconnected or removed accidentally from bracket 38.

With respect to a bunk bed there would be an upper set of mounting brackets and a lower set of mounting brackets affixed to each post of the end frame members 16 so as to correspond to the mounting of the respective upper and lower frame sections.

It may thus be seen that the objects of the present invention set forth herein, as well as those made apparent from the foregoing description, are efficiently attained, While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. In combination a means for attaching and securing a horizontal, tubular, supporting frame member to a vertical post member, wherein the improvement comprises:

an attaching means defined by a depending tongue member fixedly secured adjacent one end of the tubular supporting frame member, and a mounting bracket fixedly attached to the post member and formed to receive said depending tongue member therein;

a securing means defined by an elongated screw mounted through the post member so as to extend within the horizontal tubular supporting frame member; and a nut member transversely mounted in said tubular supporting frame member and positioned therein, whereby said screw is threadably received in said nut member so that said tongue member is secured in place within said mounting bracket of said post.

2. The combination as recited in claim 1, wherein said tongue member is formed in a substantially wedge-shaped triangular configuration, wherein one side of said tongue member is formed having a downwardly inclined edge, and wherein said bracket member defines a closed tapered sleeve having an opening formed therein to correspond to the configuration of said tongue member.

3. In combination with a bunk bed formed from a substantially tubular structure that includes at least one mattress supporting frame structure defined by a pair of tubular supporting frame members and a pair of end frame members having a pair of side posts, wherein the improvement comprises:

an attaching means defined by a depending tongue member fixedly secured adjacent the terminating ends of said tubular supporting frame members and a mounting bracket fixedly attached to said post members which are formed to receive said corresponding depending tongue members of said tubular supporting frame members;

a securing means defined by an elongated screw mounted through each of said post members so as to extend within each of said respective corresponding tubular supporting frame members; and a nut member transversely mounted adjacent the ends of said tubular supporting frame members and positioned therein, whereby said screw is threadably received in said nut member so that said tongue members are secured in place within said mounting bracket on said post.

4. The combination as recited in claim 3, wherein said tongue member is formed in a substantially wedge-shaped configuration; and wherein said bracket member defines a closed tapered sleeve having an opening formed therein to correspond to the wedge-shaped configuration of said tongue member.

5. The combination as recited in claim 4, wherein said bed structure comprises a bunk bed having an upper mattress-support frame structure and a lower mattress-support frame structure.

6. The combination as recited in claim 3, wherein said tongue member is formed in a substantially triangular configuration, one edge of which is formed having a downwardly inclined edge; and wherein said bracket member defines a closed tapered sleeve having a corresponding triangular opening formed therein to correspond to the triangular configuration of said tongue member.

* * * * *